United States Patent [19]

Voelz

[11] Patent Number: 4,488,749

[45] Date of Patent: Dec. 18, 1984

[54] SPREADER ASSEMBLY

[75] Inventor: Richard F. Voelz, Butler, Wis.

[73] Assignee: Renner Manufacturing Company, Milwaukee, Wis.

[21] Appl. No.: 414,610

[22] Filed: Sep. 3, 1982

[51] Int. Cl.[3] ..... B66C 1/00

[52] U.S. Cl. ..... 294/815 F

[58] Field of Search ..... 294/815 F, 67 DA, 67 D, 294/67 R, 81 R, 88, 110; 414/620, 621, 730

[56] References Cited

U.S. PATENT DOCUMENTS

| | | | |
|---|---|---|---|
| 2,842,391 | 7/1958 | Hermann | 294/67 |
| 3,101,967 | 8/1963 | Wyrough | 294/67 |
| 3,514,146 | 5/1970 | Zweifel et al. | 294/67 |
| 3,627,370 | 12/1971 | Whiteman | 294/67 |
| 3,677,599 | 7/1972 | Shannon | 294/67 |
| 3,752,346 | 8/1973 | Thompson | 214/621 |
| 3,767,250 | 10/1973 | Ward | 294/81 |
| 3,770,309 | 11/1973 | Merchant et al. | 294/81 |
| 3,799,601 | 3/1974 | Johannson | 294/81 |
| 3,863,970 | 2/1975 | Gottlieb | 294/67 |
| 3,874,719 | 4/1975 | Goyarts | 294/81 |
| 3,888,536 | 6/1975 | Durenec | 294/82 |
| 4,209,195 | 6/1980 | Holmes | 294/81.4 |
| 4,219,228 | 8/1980 | Duckett | 294/81 |

OTHER PUBLICATIONS

Star Iron & Steel Co. Brochure "The Star Karricon".
Paceco Brochure "Paceco Translines".
Valmet Brochure "Valmet Mobile Gantry Crane".
Drott Brochures "Drott Travelift" and Drott 770 TC Travel Carrier.
Clark Equipment Brochure.
Rapco Brochure.

*Primary Examiner*—James B. Marbert
*Attorney, Agent, or Firm*—Fred Wiviott

[57] ABSTRACT

A spreader assembly includes a frame and first and second spreader arms each including a pair of parallel spaced-apart beam members. The beam members are equal in length to each other and to the frame and each beam member has vertically spaced-apart rails. The frame also includes first and second pairs of bearings disposed above the horizontal center and on one side of the vertical center of the frame and third and fourth pairs of bearings disposed below the horizontal center and on the other side of the vertical center of the frame. In addition, the first and third pairs of bearings are disposed on the frame closer to the vertical center than the second and fourth pairs of bearings and the second and third pairs of bearings are disposed closer to the horizontal center of the frame than first and fourth pairs. The spreader arms are positioned on the frame with the rails of the first arm engaging the first and second pairs of bearings and the rails of the second arm engaging the third and fourth pairs of bearings. In addition, means are provided for simultaneously moving the spreader arms on the frame in equal and opposite increments.

3 Claims, 7 Drawing Figures

SPREADER ASSEMBLY

SUMMARY OF THE INVENTION

It is an object of the invention to provide a new and improved spreader assembly for handling cargo containers.

Another object of the invention is to provide spreader assembly which is simple and economical.

A further object of the invention is to provide a spreader assembly wherein the arms are extended and retracted relative to the frame in equal and opposite increments.

These and other objects and advantages of the present invention will become more apparent from the detailed description thereof taken with the accompanying drawings.

In general terms, the invention comprises a spreader assembly having a frame and first and second spreader arms. Each spreader arm comprises a pair of beam members joined in a parallel spaced-apart relation and has a pair of vertically spaced-apart rails, with the beam members of each arm being spaced the same distance as those of the other and having a length substantially equal to that of the frame.

The frame has first, second, third and fourth pairs of bearing means with the first and second pairs of bearing means being disposed above the horizontal center of said frame and on one side of the vertical center thereof, the third and fourth pairs of bearing means being disposed below the horizontal center of the frame and on the other side of the vertical center. In addition, the first and third pairs of bearings are disposed on the frame closer to the vertical center thereof than the second and fourth pairs of bearing means and the second and third pair of bearing means are closer to the horizontal center of the frame than the first and fourth bearing means. The first spreader arm extends through one end of the frame and engages the first and second bearing means and the second spreader arm extends through the other end of the frame and engages the third and fourth bearing means. Means are also provided for simultaneously moving the spreader arms in equal increments and in opposite directions on the bearing means and relative to the frame.

BACKGROUND OF THE INVENTION

This application relates to cargo handling apparatus and more particularly to a spreader assembly for handling cargo containers.

One type of apparatus for handling cargo containers is a gantry-type crane. Containers are suspended from the crane by means of a spreader assembly which generally comprises a frame in a pair of arms. A pair of coupling members at the end of each arm is adapted to engage mating recepticles in the upper corners of the container for releasably coupling the spreader to the container. While such containers generally have standard widths, they are provided in a variety of lengths. As a result, the arms of the spreader assembly are preferably adjustable longitudinally relative to the frame for being coupled to different sized containers. For reasons of stability, it is desirable that the arms extend the same distance from the frame when supporting a cargo container.

DETAILED DESCRIPTION OF THE PREFERRED EMBODIMENT

Figure 1:
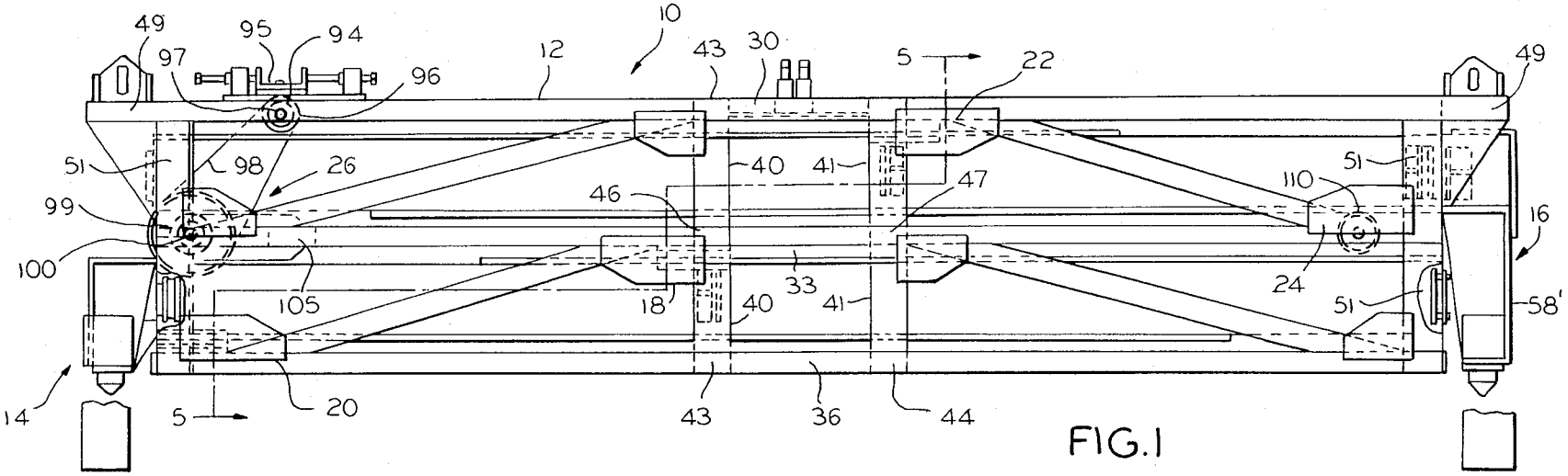
FIG. 1 is a side elevational view of the spreader assembly according to the present invention.
Figure 2:
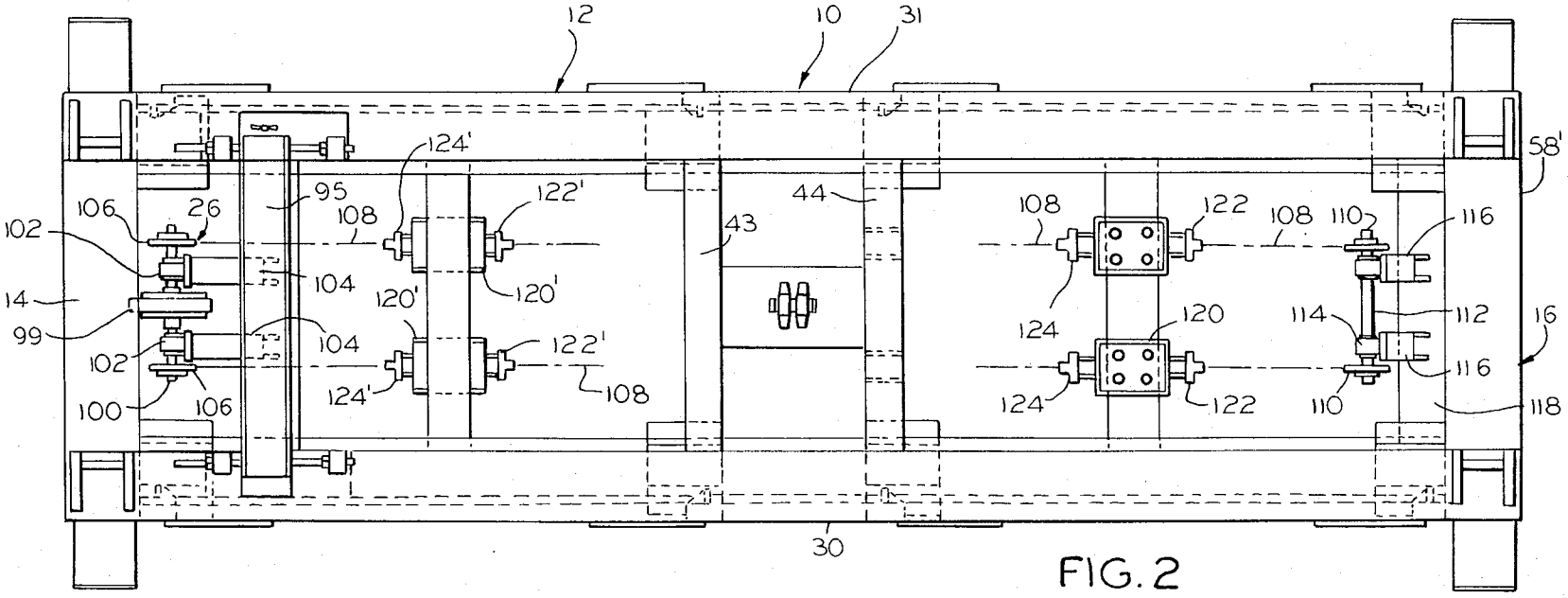
FIG. 2 is the top plan view of the spreader assembly shown in FIG. 1.

A spreader assembly 10 according to the preferred embodiment of the invention is shown in FIGS. 1 and 2 to include a frame 12, a first spreader arm 14, and a second spreader arm 16. The frame 12 includes a first group of bearings 18 and 20 and a second group of bearings 22 and 24 for respectively supporting the arms 14 and 16 for sliding movement in opposite longitudinal directions relative to the frame 12. While only the bearings on one side of the frame 12 can be seen in FIG. 1, it will be appreciated that identical groups of bearings are disposed on the opposite sides thereof.

A drive mechanism 26 is mounted on the frame 12 for simultaneously moving the spreader arms 14 and 16 so that the assembly can accommodate different sized containers. In addition, each arm has an actuating mechanism 28 (See FIG. 6) for rotating the locks 29 which are located at the outside corner of each arm 14 and 16 for releasable attachment to receptacles on the container being supported in a manner well known in the art.

The frame 12 includes pairs of horizontal, spaced-apart, parallel top beams 30 and 31, center beams 33 and 34 and bottom beams 36 and 37. The beams 30, 31, 33, 34, 36 and 37 are each rectangular in cross-section and are fixed in mutually parallel spaced-apart relation and in a rectangular array by a plurality of spaced cross members. In particular, there are pairs of spaced-apart, parallel, vertical cross members 40 and 41 extending along the sides of the frame and between adjacent beams 30–33, 33–36, 31–34 and 34–37. In addition, pairs of horizontal, spaced-apart, parallel cross members 43 and 44 extend along the top and bottom of the frame and between the beams 30–31 and 36–37 and a pair of cross members 46 and 47, extend between beams 33–34 and along the center of the frame 12. As seen in FIGS. 1 and 2, the cross members 40, 41, 43, 44, 46 and 47 are disposed adjacent to and symmetrical relative to the center line of the frame 12.

The upper beams 30 and 31 are longer than the remaining beams and their overhanging ends are joined by relatively larger cross members 49. Vertical and horizontal cross members 51 also join the ends of the remaining beams 33, 34, 36 and 37 to each other into the beams 30 and 31.

Figure 3:
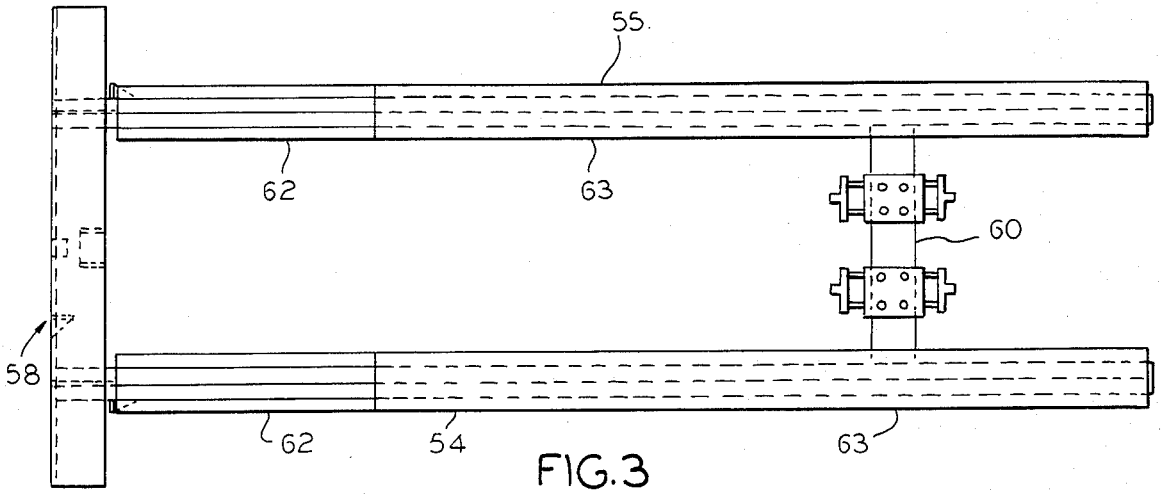
FIG. 3 is a side elevational view of one of the arms of the spreader assembly of FIG. 1.
Figure 4:
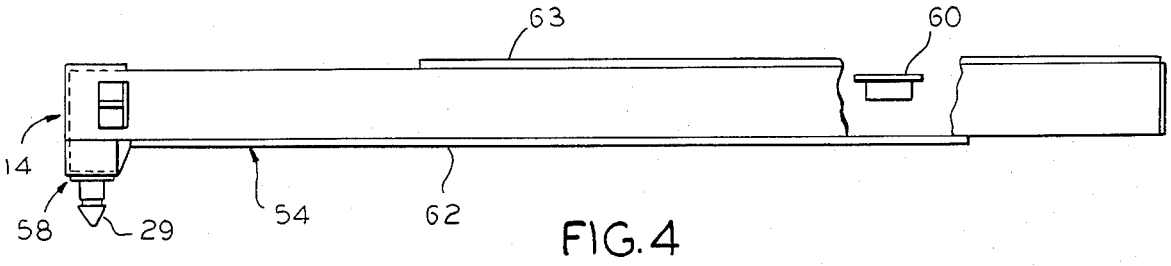
FIG. 4 is a top plan view of the spreader assembly arm shown in FIG. 3.
Figure 5:
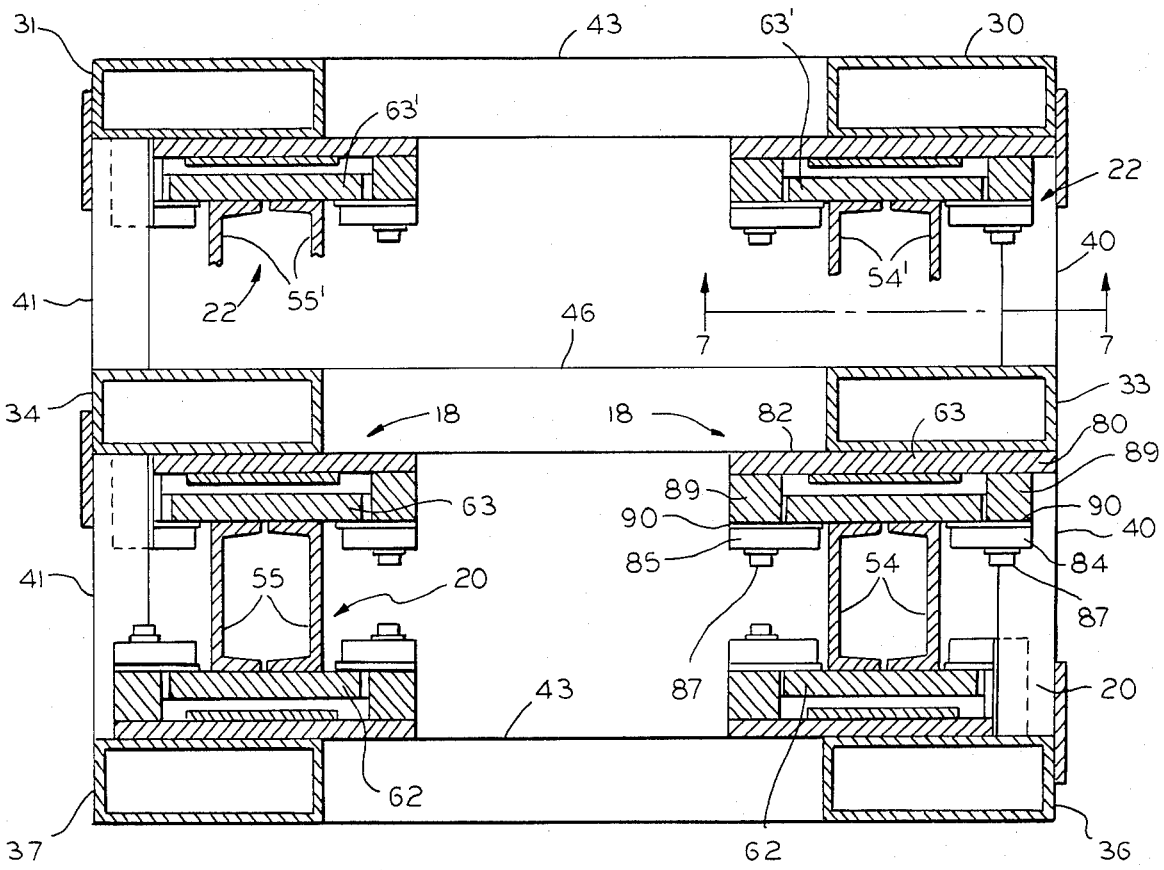
FIG. 5 is a view taken along lines 5—5 of FIG. 1.

The arms 14 and 16 are mirror images of each other except that the arm 16 has an end portion of greater height as will be described more fully below. Accordingly, only the arm 14 will be discussed in detail with like portions of the arm 16 being identified by the same reference numerals, except that they are distinguished by a prime (′). In particular, the arm 14 as shown in FIGS. 3 and 4 to include a pair of beam members 54 and 55 which are joined in a parallel, spaced-apart relation by an end assembly 58 and a cross-member 60 which extends perpendicularly between the beam members and adjacent their opposite ends. As seen in FIGS. 3, 4 and 5 the beam members 54 and 55 each comprise a rectangular section and there is a bottom rail 62 extending from the end assembly 58 to a point just past the cross member 60 and a top rail 64 which extends from the opposite end to a point between the center of beam 54 and end assembly 58. Beam member 55 has identical rails 62 and 64 and the rails of each beam are slideably received in the bearing assemblies 18 and 20 of frame 12.

Figure 7:
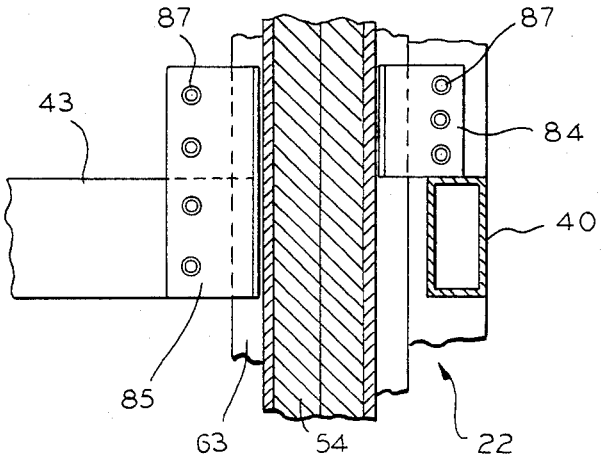
FIG. 7 is a view taken along lines 7—7 of FIG. 1.

The end assembly 58 of arm 14 includes an elongated housing 66 fixed to the ends of beam members 54 and 55 and which encloses an operating assembly 68 for the coupling member 29. The operating assembly 68 is suitably supported within the housing 66 and is shown in FIG. 7 to include a double acting hydraulic cylinder 70 coupled to one end of a crank arm 71 pivotally mounted about a fixed pivot 73. A pair of connecting rods 74 are coupled to the other end of crank arm 71 and extend in opposite directions for being connected to crank arm 76 disposed adjacent the ends of housing 58. The coupling members 29 are fixed to the arm 76 and extend along the pivot axis thereof and through bearings 77. It will be appreciated that when one end of the cylinder 70 is pressurized to pivot the crank arm 71 to its position shown by broken lines, the connecting rods 74 will be moved to the left as viewed in FIG. 7, thereby pivoting each of the arms 76 to rotate the coupling members 29 through an angle of about 90°. On the other hand, when the crank arm 71 is in its position show by broken lines and the opposite end of cylinder 70 is pressurized, the coupling members 29 will be rotated about 90° in the opposite direction. In this manner, the members 29 can be coupled and uncoupled from mating recepticles in the corners of a container (not shown) in a manner well known in the art.

In order to guide the frame 12 relative to the container (not shown), guides 78 may be provided adjacent the opposite sides of end assembly 58.

Figure 6:
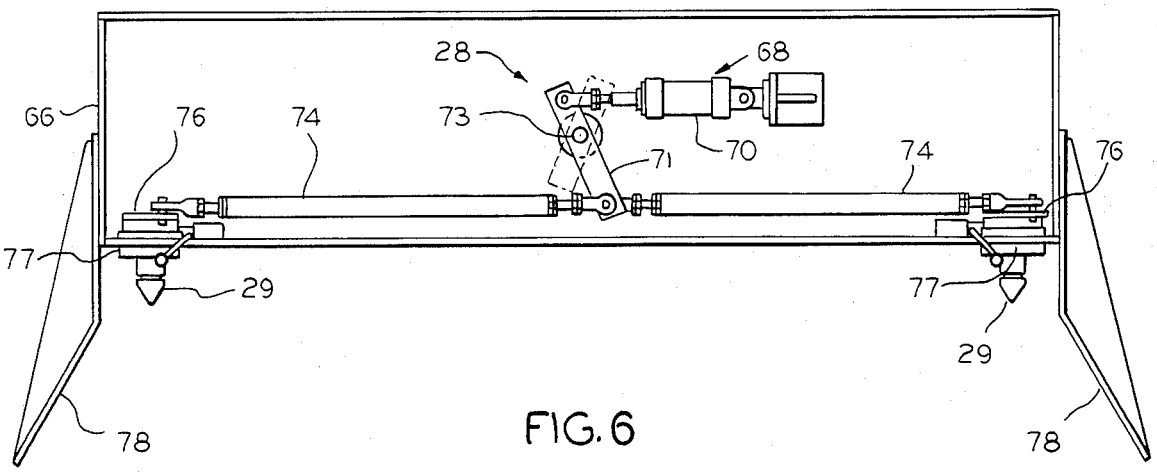
FIG. 6 is a view taken along lines 6—6 of FIG. 5.

As seen in FIGS. 1 and 2, the bearings 18 are located on the lower surfaces of beams 33 and 34 and adjacent the vertical cross members 40, 46; the bearings 20 are located on the upper surfaces of beams 36 and 37 adjacent the left ends thereof; bearings 22 are located on the lower surfaces of beams 30 and 31 adjacent the cross members 41 and 44; and bearings 24 are located on the upper surfaces of beams 33 and 34 and adjacent the right end thereof. The bearings 18 are shown in FIGS. 5 and 6 to include a first plate 80 fixed below beam 33 and cross member 46. A wear plate 82 is secured below plate 80 and generally centrally thereof and a pair of bearing members 84 and 85 are fixed to plate 80 by bolts 87 and are spaced therefrom by spacers 89. Each bearing member 84 and 85 is also provided with a wear plate 90. As seen in FIG. 5, bearing members 84 and 85 are mounted in a parallel spaced-apart relation and bearing member 85 is shorter than member 84 to accommodate cross member 40.

The bearing member 20 as shown in FIG. 5 to be a vertical mirror image of bearing 18 while the bearing 18 at the opposite side of the assembly is shown to be a horizontal mirror image thereof. Accordingly, like portions of the bearing assemblies 18 and 20 will not be described in further detail but the corresponding portion thereof will be given the same reference numerals.

As seen in FIG. 5, the wear plates 82 of bearings 18 and 20 are spaced apart a distance slightly greater than that between the upper and lower surfaces of rails 62 and 63, while the distances between the wear plates 82 and 90 of each bearing are spaced apart a distance slightly greater than the thickness of the rails 62 and 63 respectively. Additionally, the vertical distance between the wear plates 90 in each bearing 18 and 20 will be approximately equal to the distance between the upper surface of rail 62 and the lower surface of rail 63. Thus, when the arm 14 is disposed within the frame 12 as shown in FIG. 1, the rail 62 will bear against the wear plates 90 of bearing 20 and the rail 63 will bear against the wear plates 90 of bearing 18. Similarly, the beam member 55 of arm 14 will ride in corresponding bearings 18 and 20 at the opposite side of the frame 12.

As indicated previously, the arm 16 is a mirror image of arm 14 except that the end assembly 58' of arm 16 is a greater height than the end assembly 58 of arm 14. Because the beams 54 and 55 of arm 14 and 54' and 55' of arm 16 are equally spaced-apart in a horizontal direction, the bearings 18 and 20 which support arm 14 and bearings 20 and 24 which support arm 16 are also equally spaced apart from the corresponding bearings of the opposite side of the frame 12. Further, as seen in FIG. 1, the lengths of the beams 54 and 55 of the arms 14 and beams 54' and 55' of arm 16 are substantially equal in length to the frame 12 and the bearings 18 and 20 which support arm 14 are below the horizontal center of frame 12 and on one side of the vertical center and the bearings 22 and 24 which support arm 16 are above the horizontal center of frame 12 and on the other side of the vertical center. As a result, when the arms 14 and 16 are in a retracted position shown in FIGS. 1 and 2, the arm 16 is vertically above the arm 14.

The drive assembly 26 for positioning the arms 14 and 16 includes a drive motor 94 fixed below a support plate 95 which is adjustably mounted on beams 30 and 31 and adjacent one end of the frame 12. A sprocket 96 is mounted on the motor output shaft 97 and is coupled by a chain 98 to a first sprocket 99 mounted on a shaft 100 journaled in bearings 102 supported on brackets 104 projecting from a cross member 105 extending between beams 33 and 34. Also mounted on shaft 100 and equally spaced on the opposite sides of sprocket 98 are a pair of sprockets 106, each of which is coupled respectively by a chain 108 to the arms 14 and 16. Chains 108 also extend around a second pair of spaced-apart sprockets 110 mounted on shaft 112 which is journaled in bearings 114 supported on brackets 116 projecting from a cross member 118 extending between beams 33 and 34 at the opposite end of frame 12.

The chains 108 are respectively coupled to the arms 14 and 16 by means of a first pair of plates 120 fixed in spaced relation on the upper surface of cross member 60 of arm 14 and a second pair of plates 120' fixed to the lower surface of cross member 60 of arm 16. In particular, a first segment of each chain 108 extends over its respective sprocket 106 and is connected by a coupling 122 to one side of the first pair of plates 120. A second pair of couplings 124 mounted on the other side of plates 120 are connected to a second segment of chain 108 which extends over sprockets 112 and then backwardly to a first pair of coupling members 124' extending from one side of coupling members 120'. The other side of the first segment of the coupling chain is connected to coupling members 122' mounted on the other end of plates 120' and extend around sprockets 106 to the coupling members 122 as described above.

It will be appreciated that when the arms are in their retracted position shown in FIG. 1 and the motor 94 is driven in the clockwise direction, the arm 14 will be moved toward the left and the arm 16 to the right. This will extend the arms to accommodate a container of the size larger than the frame 12. Suitable limit switches (not shown) will deactivate the motor 94 as the arms approach their travel limit in the event the motor is not deenergized by the operator prior to that time. When it is desired to retract the arms, the motor 94 will be driven in the opposite direction, thereby drawing the arms 14 inwardly toward the right and the arm 16 inwardly and toward the left. Again, suitable limit switches (not shown) will deactivate motor 94 when the arms reach the inward extent of their retraction.

While only a single embodiment of the invention has been illustrated and described, it is not intended to be limited thereby but only by the scope of the appended claims.

I claim:

1. A spreader assembly comprising a frame and first and second spreader arms, each said spreader arm comprising a pair of beam members and means joining said beam members in a parallel spaced-apart relation, the beam members of one arm being spaced the same distance as those of the other, said beam members having a length substantially equal to that of said frame, each beam member having a pair of vertically spaced-apart rail means, said frame having first, second, third and fourth pairs of bearing means, said first and second pairs of bearing means being disposed above the horizontal center of said frame and on one side of the vertical center thereof, said third and fourth pairs of bearing means being disposed below the horizontal center of said frame and on the other side of the vertical center thereof, said first and third pairs of bearings being disposed on said frame closer to the vertical center thereof than said second and fourth pairs of bearing means and said second and third pair of bearing means being closer to the horizontal center of said frame than said first and fourth bearing means, said first spreader arm extending through one end of said frame and engaging said first and second bearing means and said second spreader arm extending through the other end of said frame and engaging said third and fourth bearing means, and means for simultaneously moving said spreader arms in opposite directions on said bearing means and relative to said frame.

2. The spreader assembly set forth in claim 1 wherein said first spreader arm is disposed vertically above said second spreader arm when the same are in a retracted position relative to said frame.

3. The spreader assembly set forth in claims 1 or 2 and including ratchet means disposed in spaced-apart relation on said frame, chain means extending around said ratchet means and being connected to each of said first and second spreader arms, and means for rotating at least one of said ratchet means for simultaneously moving said spreader arms in opposite directions and through equal increments.

* * * * *